US005826350A

United States Patent [19]

Wallerstein

[11] Patent Number: 5,826,350

[45] Date of Patent: Oct. 27, 1998

[54] SHOE CONSTRUCTION PROVIDING SPRING ACTION

[76] Inventor: Robert W. Wallerstein, 9782 Tottenham Ct., Los Angeles, Calif. 90210

[21] Appl. No.: 889,093

[22] Filed: Jul. 7, 1997

[51] Int. Cl.[6] ..... A43B 13/28

[52] U.S. Cl. ..... 36/7.8; 36/27

[58] Field of Search ..... 36/7.8, 27, 31, 36/28, 113

[56] References Cited

U.S. PATENT DOCUMENTS

| | | | |
|---|---|---|---|
| 4,566,206 | 1/1986 | Weber | 36/27 X |
| 4,592,153 | 6/1986 | Jacinto | 36/27 X |
| 5,138,776 | 8/1992 | Levin | 36/27 X |
| 5,706,589 | 1/1998 | Marc | 36/27 |

FOREIGN PATENT DOCUMENTS

| | | | |
|---|---|---|---|
| 2658396 | 8/1991 | France | 36/27 |

*Primary Examiner*—B. Dayoan
*Attorney, Agent, or Firm*—Larson & Taylor

[57] ABSTRACT

A shoe for running, cross training and the like includes a base member including a raised front portion and a rearwardly extending sole portion. A U-shaped spring is disposed beneath the raised portion. The spring has tranvsersely extending ends engaging the front portion at respective longitudinally spaced locations. A sole spring element is affixed to the front portion of base member and includes a flexible part overlying, and extending rearwardly beyond, the sole portion of the base member. The flexible part of the sole spring element is disposed at an acute, non-zero angle with respect to the sole portion of the base member.

20 Claims, 2 Drawing Sheets

SHOE CONSTRUCTION PROVIDING SPRING ACTION

FIELD OF THE INVENTION

The present invention relates to an improved shoe construction which is particularly useful as a running shoe, training shoe or the like.

BACKGROUND OF THE INVENTION

In general, running or walking involves a specific pattern or sequence of events insofar as the foot is concerned. In particular, the heel impacts the ground first, the weight then shifts forward onto the ball of the foot and next the forefoot and toe region provide the last contact with the ground as the foot is lifted from the ground. The initial impact in the heel area is of special interest with runners because, in general, it is desirable to absorb as much impact energy as possible, consistent with providing a stable landing and without slowing down the runner. A further consideration in a shoe construction of this type is that of actually enhancing the performance of the wearer by, e.g., providing built-in spring force that facilitates the weight shift mentioned above and also assists in propelling the foot off the ground.

A number of patents relate to shoe constructions which are variously designed to address one or more of the issues discussed above. For example, U.S. Pat. Nos. 5,596,819 and 5,437,110 (Goldston et al.) disclose an adjustable shoe heel spring and stabilizer device for a running shoe including a spring mechanism disposed in the mid-sole of the shoe and including a cantilevered spring member and an adjustable fulcrum therefor. U.S. Pat. No. 4,492,046 (Kosova) discloses a running shoe which includes a spring wire located in a longitudinal slot in the shoe sole extending from the back edge thereof into the arch region. U.S. Pat. No. 2,447,603 (Snyder) discloses a U-shaped spring plate disposed between the heel of the shoe and overlying a rear portion of the shoe sole. Other U.S. patents of possible interest include: U.S. Pat. Nos. 2,444,865 (Warrington); 3,822,490 (Murawski); 4,592,153 (Jacinta); 5,343,636 (Sabol); 5,435,079 (Gallegos); 5,502,901 (Brown); 5,511,324 (Smith); 5,517,769 (Zhao); and 5,544,431 (Dixon).

SUMMARY OF THE INVENTION

In accordance with the invention, an improved shoe or shoe construction is provided which affords important advantages including, inter alia, cushioning the initial impact on the heel area, facilitating the shifting of the weight of a wearer from the heel area to the ball of the foot, and enhancing lift-off from the ground in the toe and ball area of the foot.

According to a preferred embodiment of the invention, a shoe construction is provided which comprises a base member including a raised front portion and a rearwardly extending sole portion, a flexible spring member disposed beneath the front portion of the base member, and a spring element including a front portion secured to the front portion of the base member and a flexible rear portion disposed at an acute, non-zero angle with respect to the sole portion of the base member.

Preferably, the spring member comprises a substantially U-shaped spring having free ends affixed to the front portion of said base member at longitudinally spaced locations. Advantageously, the spring member further comprises a support shell which is secured to the front portion of said base member and in which the U-shaped spring is slidably received so as to permit removal of the spring. The support shell preferably includes first and second, longitudinally spaced, transversely extending rails against which the free ends of the U-shaped spring engage.

The base member preferably includes a curved portion located between the front portion and the sole portion for enhancing shifting of the weight of a wearer to the ball of the foot.

Advantageously, the sole portion of the base member is covered with a bottom sole. The bottom sole preferably comprises a perforated subsole having a plurality of spaced perforations therein and a porous underlayer covering the perforated subsole.

Preferably, the rear portion of the spring element is of greater flexibility than the front portion of the spring element. The rear portion of said spring element is advantageously comprised of a flexible graphite material which resists side to side torsion, and the front portion of the spring element is comprised of a graphite composite.

Advantageously, the acute angle between the flexible rear portion of said spring element and the sole portion of the base member is a value which lies between 20° and 25°. Preferably, the distal end of the rear portion of the spring element extends beyond the distal end of the rearwardly extending sole portion of the base member. In an advantageous implementation, the distal end of the rear portion of the spring element is located at a spacing of between 3 to 3½ inches above the distal end of the rearwardly extending sole portion. Advantageously, a reinforcement member is disposed between the rear portion of the spring element and the rearwardly extending portion of the base member. A mounting means is preferably provided for removably mounting the reinforcement member on said rear portion of the spring element. The mounting means advantageously comprises a plurality of spaced support straps affixed to the rear portion of the spring element.

A cushion element is preferably disposed at the distal end of said rear portion of said spring element. A retaining strap is advantageously affixed to said sole portion of said base member and extending around said rear portion of said spring element. The retaining strap preferably includes an openable fastener. In addition, the shoe construction advantageously further comprises a retaining strap means affixed to the front portion of the base member and extending above the front portion of the spring element for receiving the front part of the foot of a wearer.

Other features and advantages of the invention will be set forth in, or apparent from, the detailed description of the preferred embodiments of the invention which is found hereinbelow.

DESCRIPTION OF THE PREFERRED EMBODIMENTS

Figure 1:
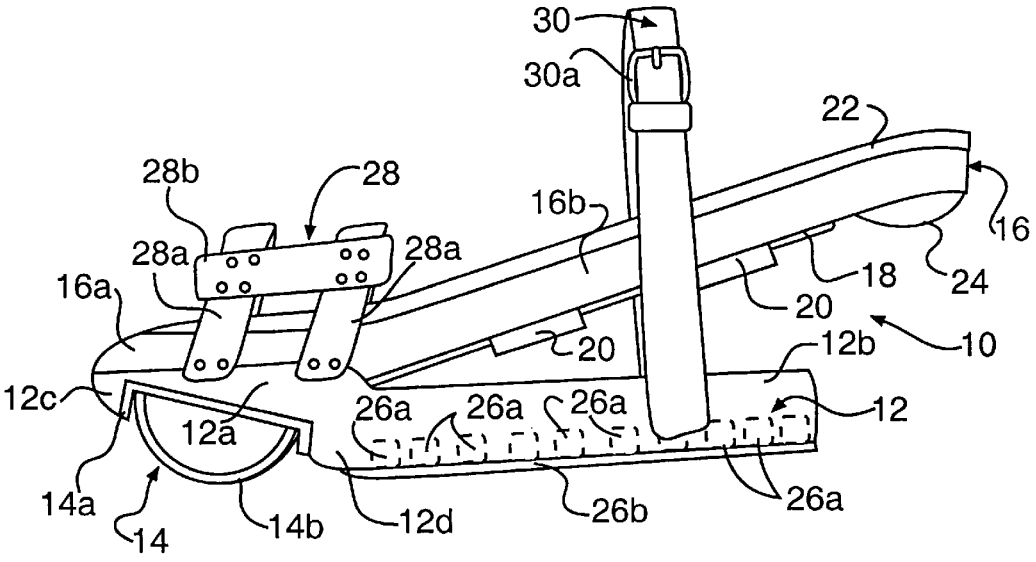
FIG. 1 is a side elevational view of a shoe construction in accordance with a preferred embodiment of the invention.

Referring to FIG. 1, an exemplary embodiment of the shoe construction of the invention is shown. It should be understood that the illustrated embodiment is simply one example of a suitable overall shoe construction and the basic elements and principles of the invention, which are described more generally in connection with FIGS. 2(*a*) to 2(*e*), have general application. In this regard, the invention can, for example, be incorporated in a more conventional looking running shoe if desired.

In the illustrated embodiment, the shoe construction or shoe, which is generally denoted 10, includes a base member 12 including a raised, rigid front or sole support portion 12*a*, and an integral rigid subsole portion 12*b* stepped down from the front portion 12*a* and extending rearwardly therefrom. Base member 12 is preferably made of a rigid carbon graphite with an aluminum rod support, or of a like material and construction. A bowed, flexible spring member 14 is disposed beneath, and secured to, front portion 12*a* of base member 12. In a preferred embodiment, a small lip 12*c* (e.g., of ¼" extent) is provided at the toe of base member 12. As illustrated, spring member 14 is disposed substantially directly under the ball of the foot and extends between the front of front portion 12*a* to a rear part of front portion 12*a* adjacent to a curved portion 12*d* of subsole 12*b*. The curvature of curved portion 12*d* is such as to enhance shifting of the weight of a wearer to the ball of the foot during running or walking as described in more detail below. The spring member 14 is preferably made of spring steel, flexible carbon graphite or the like.

In a preferred embodiment shown in FIG. 1, spring member 14 is of a two piece construction comprising a support shell or support housing 14*a* of an inverted, squared off U-shape and a spring 14*b* of a bowed or shallow generally U-shape. The ends of support shell 14*a* form two longitudinally spaced, transversely extending rails and support shell 14*a* is preferably constructed, e.g., of aluminum. As illustrated, the free ends of spring 14*b* engage against, but are not secured to, the respective rails formed by shell support 14*a*. With this construction, spring 14*b* can be slid in and out of shell 14*a* to enable replacement or substitution. Spring 14 preferably extends across the full width of the shoe 10 although the spring 14 can be more narrow if desired.

Secured to the front portion 12*a* of base member 12 is a sole spring element 16. Sole spring element 16 includes a front portion 16*a* which is preferably comprised of a non-flexible graphite composite, which is affixed to the front portion at 12*a* of base member 12 and on which rest the toes and ball of the feet of a wearer. Sole spring element 16 further includes a rear portion 16*b* which is preferably comprised of a flexible graphite material that resists side to side torsion, and which extends rearwardly of front portion 16*a* at an acute, non-zero angle with respect to subsole 12*b*. In a specific, non-limiting example, rear portion 16*b* forms an angle between about 20° and 25°, and preferably of about 22°, with subsole 12*b*, and the distal end of rear portion 16*b* is located about 3 to 3.5 inches above the plane of the ground. Although this height is advantageous, other heights can be used and, in general, a height of between about 1 and 6 inches could be workable. As illustrated, the distal end portion of sole spring element 16 extends a substantial distance beyond subsole 12*b*.

A supplementary, and optional, reinforcement member 18 is located between sole spring element 16 and subsole 14*b*, and, in the illustrated embodiment, is supported beneath sole spring element 16 by a series of spaced support straps or loops 20 secured to the undersurface of element 16. Alternatively, reinforcement member 18 can be received and held in a longitudinal groove or channel (not shown) formed in the bottom surface of rear portion 12*b* or can be affixed, at the front end thereof, to the front portion 12*a* of base member 12, e.g., by being secured in place in a slot or recess in front end portion 12*a* in a cantilever fashion. Reinforcement member 18 is preferably made of spring steel, flexible carbon graphite or the like. Reinforcement member 18 is preferably removable and can be replaced with a similar member having different characteristics, e.g., one providing additional spring force or one providing variable spring action because of the shape or construction thereof.

In the illustrated embodiment, an overlay, indicated 22 and made of rubber or the like, is provided on the upper surface of sole spring element 16, and a cushion element 24 of rubber or the like is provided at the distal end or heel portion of sole spring member 16.

In a preferred embodiment indicated schematically in FIG. 1, the subsole 26, which is made of a rigid, light material, is of a perforated or grate-like construction including a plurality of perforations or holes 26*a* therein and is covered by a porous rubber bottom member or underlayer 26*b*. This enables water, and air, to rise up through the underlayer 26*b* into the holes 26*a* when the wearer is running on a wet surface to thereby prevent hydroplaning and increase the aerodynamics of the shoe.

In the embodiment shown in FIG. 1, an open strap assembly 28, comprising a pair of transverse, U-shaped straps 28*a* interconnected by longitudinally extending connector straps 28*b* made of Nylon or the like, is affixed to the front portion 12*a* of base member 12 for gripping the front of the foot of a wearer. A further, single elongate strap 30, including a buckle fastener 30*a*, is adapted to fit around the wearer's foot just in front of the ankle.

The spring action provided by shoe 10 can perhaps be best appreciated by reference to FIGS. 2(*a*) to 2(*e*) wherein the basic elements of the shoe construction, viz., base member 12, spring 14, sole spring element or member 16, and optional reinforcement member 18, are shown. FIG. 2(*a*) illustrates the relative positions of these members when the foot F of a wearer is lifted above the ground G and, in this instance, is about to land on the ground (the movement of the foot F being indicated by arrow A).

As shown in FIG. 2(*b*), as the shoe 10 hits the ground and the full weight of the wearer is received by, i.e., is brought to bear on, the shoe 10, the weight is first received by curved portion 12*d* and subsole 12*b*. Further, the rear portion 16*b* of spring element 16 begins bending backward to form an arch as indicated in FIG. 2(*b*). As a consequence, a whipping action is created as the weight of the wearer is shifted to the ball of the foot. Spring portion 16*b* thus accelerates lifting of the heel from the ground and propels the weight of the wearer forward to the ball of the foot where curved portion 12*c* acts as a pivot or fulcrum about which the weight is shifted to the front spring 14 and thus accelerates the movement of the foot in leaving the ground.

In general, spring 14 is not involved until the weight of a wearer shifts or rolls forward. Spring 14 is designed and constructed such that compression thereof begins only when more than one half of the body weight of the wearer is transferred thereto. As shown in FIG. 2(*c*), as the weight of wearer shifts forward to the ball of the foot as indicated by arrow F1, spring 14 is compressed and subsole 12*b* tips off of the ground G. As discussed above, as the force on the spring element 16 is released, the weight of the wearer is shifted to the front of the shoe 10 and the shoe 10 rolls forward on curved portion 12*d* and on spring member 14 until sufficient weight is transferred to cause spring member 14 to collapse or compress. At this point, both the heel of the foot and the subsole 12*b* are off of the ground because of the rolling or pivoting action around curved portion 12*d*.

Before the wearer begins to lift his or her foot, the weight of the wearer compresses spring 14. As the foot is lifted and weight is removed from spring 14, this spring provides a lifting force, indicated by arrow S2, on the ball area of the foot.

Figure 2A:
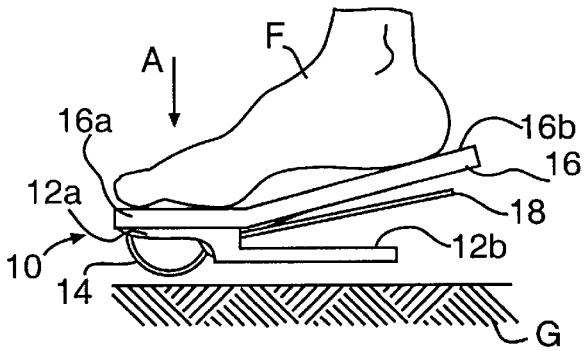
FIGS. 2(*a*) to 2(*e*) are schematic side elevations of basic elements of the shoe construction of the invention illustrating sequential stages in landing and lifting of the shoe and showing the spring action provided thereby.
Figure 2B:
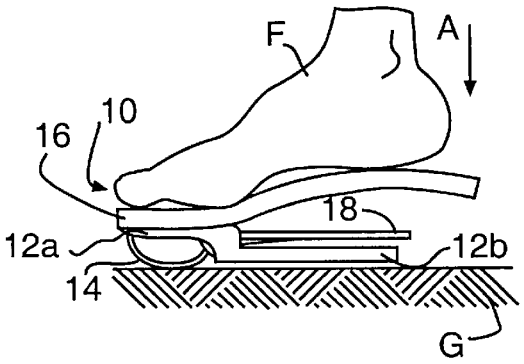
Figure 2C:
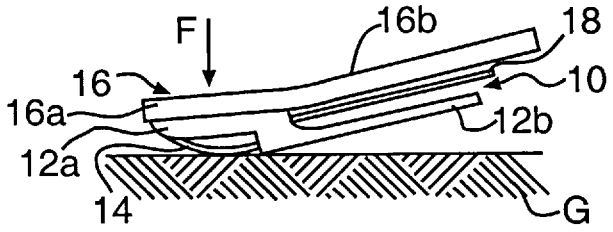
Figure 2D:
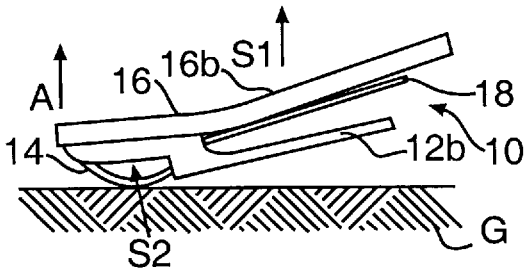
Figure 2E:
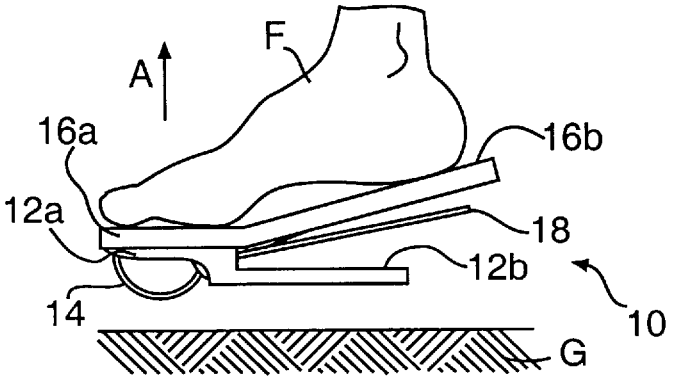

Finally, as shown in FIG. 2(*e*), all spring forces return to the initial states thereof, i.e., the states of FIG. 2*a,* when the shoe 10 is fully lifted from the ground G.

In a further alternative embodiment, a coil spring or another additional spring element (not shown) could be added in the space created within spring 14, i.e., between spring 14 and the lower surface of front portion 12*a,* to provide further spring force as needed.

Although the present invention has been described to specific exemplary embodiments thereof, it will be understood by those skilled in the art that variations and modifications can be effected in these exemplary embodiments without departing from the scope and spirit of the invention.

What is claimed is:

1. A shoe construction comprising a base member including a raised front portion and a rearwardly extending sole portion, a flexible spring member disposed beneath said front portion of the base member, and a spring element including a front portion secured to said front portion of said base member and a flexible rear portion disposed at an acute, non-zero angle with respect to said sole portion of said base member.

2. A shoe construction as claimed in claim 1 wherein said spring member comprises a substantially U-shaped spring having free ends affixed to said front portion of said base member at longitudinally spaced locations.

3. A shoe construction as claimed in claim 2 wherein said spring member further comprises a support shell which is secured to said front portion of said base member and in which said U-shaped spring is slidably received so as to permit removal of said spring.

4. A shoe construction as claimed in claim 3 wherein said support shell includes first and second, longitudinally spaced, transversely extending rails against which the free ends of said spring engage.

5. A shoe construction as claimed in claim 1 wherein said base member includes a curved portion located between said front portion and said sole portion for enhancing shifting of the weight of a wearer to the ball of the foot and raising the heel off of the ground.

6. A shoe construction as claimed in claim 1 wherein the sole portion of said base member is covered with a bottom sole.

7. A shoe construction as claimed in claim 6 wherein said bottom sole comprises a perforated subsole having a plurality of spaced perforations therein and a porous underlayer covering said perforated subsole.

8. A shoe construction as claimed in claim 1 wherein the rear portion of said spring element is of greater flexibility than said front portion of said spring element.

9. A shoe construction as claimed in claim 8 wherein said rear portion of said spring element is comprised of a flexible graphite material which resists side to side torsion, and said front portion of said spring element is comprised of a graphite composite.

10. A shoe construction as claimed in claim 1 wherein said acute angle is of a value which lies between 20° and 25°.

11. A shoe construction as claimed in claim 1 wherein the distal end of said rear portion of said spring element extends beyond the distal end of said rearwardly extending sole portion of said base member.

12. A shoe construction as claimed in claim 11 wherein said distal end of said rear portion of said spring element is located at a spacing of between 3 to 3½ inches above said distal end of said rearwardly extending sole portion.

13. A shoe construction as claimed in claim 1 further comprising a reinforcement member disposed between said rear portion of said spring element and said rearwardly extending portion of said base member.

14. A shoe construction as claimed in claim 13 further comprising mounting means for removably mounting said reinforcement member on said rear portion of said spring element.

15. A shoe construction as claimed in claim 14 wherein said mounting means comprises a plurality of spaced support straps affixed to the rear portion of said spring element.

16. A shoe construction as claimed in claim 1 comprising a cushion element disposed at the distal end of said rear portion of said spring element.

17. A shoe construction as claimed in claim 1 further comprising a retaining strap affixed to said sole portion of said base member and extending around said rear portion of said spring element.

18. A shoe construction as claimed in claim 17 wherein said retaining strap includes an openable fastener.

19. A shoe construction as claimed in claim 17 further comprising a retaining strap means affixed to the front portion of the base member and extending above the front portion of the spring element for receiving the front part of the foot of a wearer.

20. A shoe comprising a base member including a raised front portion and a rearwardly extending sole portion, a substantially U-shaped spring disposed beneath said raised portion and having transversely extending ends engaging said front portion at respective longitudinally spaced locations, and a spring element affixed to said front portion and including a flexible part overlying, and extending rearwardly beyond, said sole portion of said base member, said flexible part being disposed at an acute, non-zero angle with respect to said sole portion.

* * * * *